United States Patent [19]

Renaud

[11] 3,991,556

[45] Nov. 16, 1976

[54] CLOCK OR WATCH MOVEMENT

[75] Inventor: Jean Renaud, Marly-le-Roi, France

[73] Assignee: Societe Jaz S. A., Paris, France

[22] Filed: May 30, 1975

[21] Appl. No.: 582,139

[30] Foreign Application Priority Data

June 12, 1974 France ..... 74.20395

[52] U.S. Cl. ..... 58/59; 58/107; 58/117

[51] Int. Cl.[2] ..... G04B 15/00; G04B 17/00

[58] Field of Search ..... 58/59, 116 R, 117, 125 R, 58/107

[56] References Cited

UNITED STATES PATENTS

| | | | |
|---|---|---|---|
| 3,408,810 | 11/1968 | Meitinger | 58/59 X |
| 3,439,545 | 4/1969 | Siot | 58/116 R X |
| 3,783,608 | 1/1974 | Miyazawa | 58/116 R |
| 3,888,077 | 6/1975 | Bachmann | 58/59 |

FOREIGN PATENTS OR APPLICATIONS

| | | | |
|---|---|---|---|
| 1,465,315 | 1/1967 | France | 58/107 |

*Primary Examiner*—Stanley J. Witkowski
*Attorney, Agent, or Firm*—Edwin E. Greigg

[57] ABSTRACT

A clock or watch movement has a spindle assembly which includes an escape wheel, a pinion and a common spindle. The escape wheel is driven by a balance wheel and a driven wheel of the movement meshes with the pinion. The ends of the spindle are journalled in bearings which are adapted to permit relative movement of the spindle assembly radially of the axis of rotation of the driven wheel of the movement. A biasing spring urges the spindle assembly in the direction towards said axis.

4 Claims, 3 Drawing Figures

CLOCK OR WATCH MOVEMENT

The present invention relates to an improvement to clock movements comprising a driving balance-wheel.

In clock movements comprising a driving balance-wheel, counting of the oscillations of the balance-wheel is generally ensured by an escapement system comprising pallets. Apart from the periods when the teeth of the escapement wheel are driven, the latter is prevented from rotating by a spring co-operating with a ratchet wheel or a smooth drum. In known devices, the escapement wheel pivots in cylindrical holes provided in two plates and it supports a pinion meshing with a driven wheel whereof the spindle which also pivots in the plates is generally that which supports the second hand.

It is known that for each operation, i.e. several times per second, this device produces a noise due to the instantaneous variations of speed of the moving parts. Since it is necessary that sufficient clearances are provided, impacts are produced at various points firstly between the teeth of the pinion and the driven wheel and secondly at the points where the driven wheel is pivoted in the holes in the plates.

Accordingly, the principal object of the invention is to provide a clock or watch movement which permits the opposite ends of the spindle assembly that carries the escapement wheel to have limited movement in parallel spaced plates.

Another object of the invention is to mount a ratchet wheel on the spindle assembly, the ratchet being arranged to cooperate with a biasing means the terminal end portion of which is affixed to a support member.

Still another object of the invention is to provide a pinion on the spindle assembly, the pinion being arranged to cooperate in driving relation with a toothed wheel.

When hereafter considering this disclosure it will be noted that the pivots of the escapement wheel are able to move in the plates along an axis A–A1 joining the centers of the pinion and of the driven wheel under the action of a force exerted by a resilient member in the direction of the pinion towards the driven wheel. This improvement according to the invention makes it possible to eliminate the impact between the various parts and consequently to considerably reduce the noise of the mechanism. This result is obtained in a very simple manner without the assistance of additional parts, thus without any increase in cost to the manufacturer and purchaser.

Furthermore, it should be noted that the improvement according to the invention makes it possible to have a continuous displacement of the seconds hand, i.e. without any hesitation as may be observed in known devices.

The invention will be better understood as well as further objects and advantages thereof become more apparent from the ensuing detailed specification of a preferred embodiment taken in conjunction with the drawing.

Figure 1:
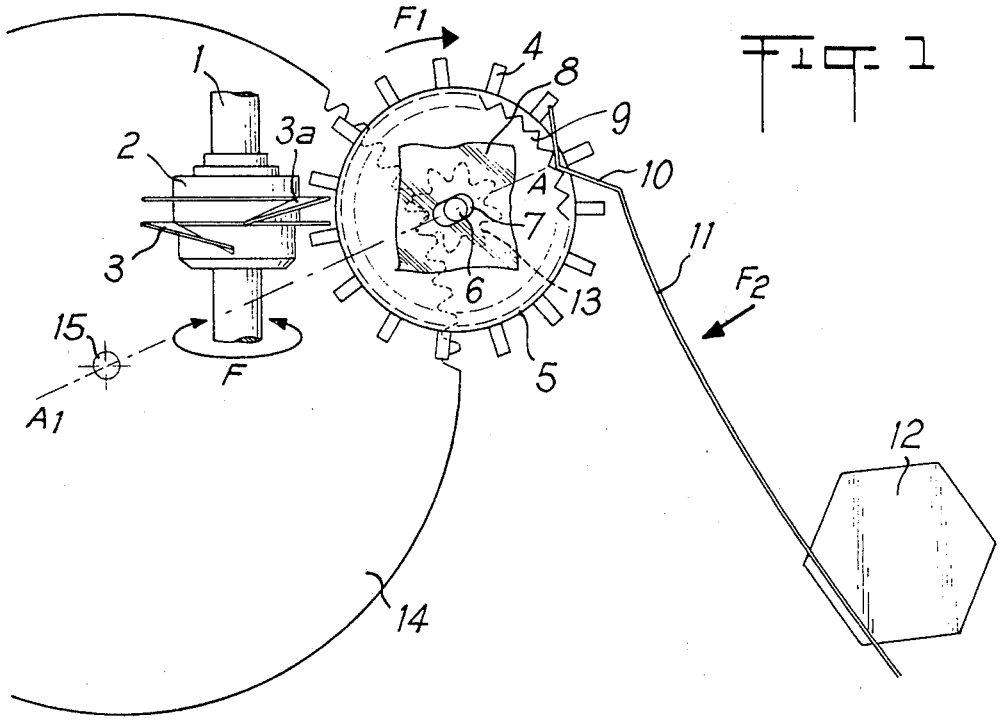
FIG. 1 is a side elevational view of one embodiment of an improved clock mechanism according to the invention.
Figure 2:
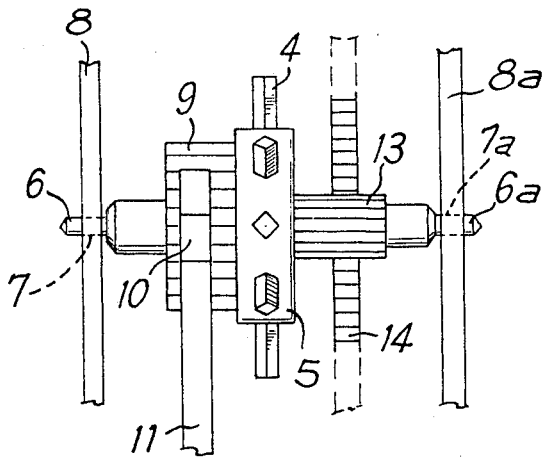
FIG. 2 is an elevational view of the mechanism on a plane offset by 90° with respect to FIG. 1.

Turning now to the drawings, FIG. 1 shows an escapement device of a clock movement comprising a staff 1 of the driving balance-wheel carrying out an alternating movement in the direction of the double arrow F and to which is secured an anchor 2 having two inclined surfaces 3, 3*a* which alternately come into contact with the teeth 4 of an escapement wheel 5 in order to rotate the latter discontinuously in the direction of arrow F1. The escapement wheel 5 is provided with two journals 6, 6*a* (see FIG. 2) which are mounted to rotate in two bearing means defining oblong holes 7, 7*a* provided in the plates 8, 8*a*. Mounted on the same axis as the escapement wheel 5 is a ratchet wheel 9 which is integral with said escapement wheel and whereof the teeth co-operate with the V-shaped end 10 of a jumper spring 11 fixed at its other end to a fixed support member 12.

Since the spring 11 exerts pressure in the direction of arrow F2 on the teeth of the ratchet wheel 9, the escapement wheel 5 is prevented from moving apart from the periods when said wheel is driven by the anchor 2.

Mounted on the same spindle as the escapement wheel 5 is a pinion 13 which is integral with said wheel and meshes with a wheel 14 whose spindle 15 which also pivots in the plates 8, 8*a* is generally that which supports the second hand.

Owing to the use of oblong holes 7, 7*a*, whereof the axis is directed along the axis A–A1, which joins the centres of the spindle 6, 6*a* of the escapement wheel 5 and the spindle 15 of the driven wheel 14, the journals 6, 6*a* may move in the oblong holes 7, 7*a* and the jumper spring 11 acting in the direction of arrow F2 exerts pressure on the arrangement constituted by the escapement wheel 5, the ratchet wheel 9 and the pinion 13 until, with the journal sliding in the oblong holes 7, 7*a*, the clearance between the pinion 13 and teeth of the wheel 14 is completely eliminated. Impact between the various parts disappears and the noise of the mechanism is considerably reduced.

As a variation, it would be possible to provide a single oblong hole 7*a* in the plate 8*a* which is nearest the pinion 13 and wheel 14, with the hole 7 in the other plate 8 being circular.

Figure 3:
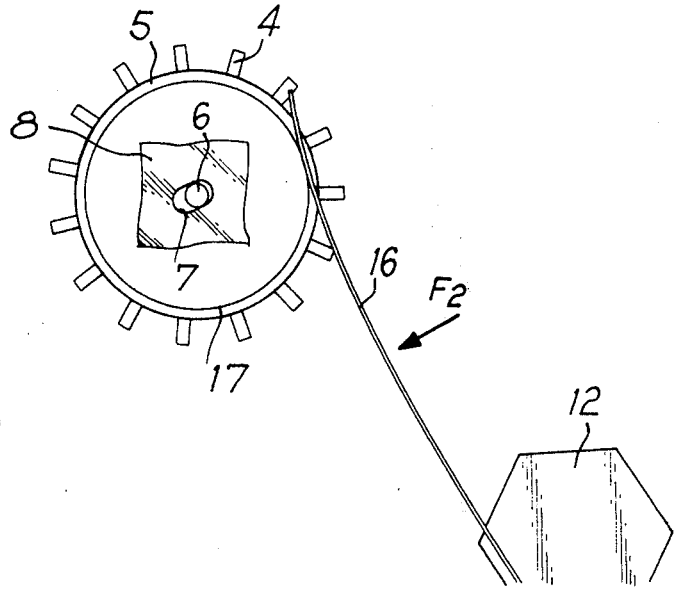
FIG. 3 is a side elevational view of a further embodiment.

Finally, FIG. 3 illustrates the improvement according to the invention in which the means for locking the escapement wheel 5 are constituted by a smooth drum 17 integral with the wheel 5 and against which presses a straight spring blade 16 which exerts a pressure F2 on the drum 17. The wheel 5 is kept stationary by friction between the blade and the free drum. As in the preceding example, the force of the pressure F2 which is exerted on the drum 17 which is integral with the escapement wheel 5 makes it possible to keep the pinion 13 in contact with the wheel 14.

Naturally, various modifications may be applied by a man skilled in the art, to the devices or methods which have been described solely as non-limiting examples, without diverging from the spirit of the invention.

What is claimed is:

1. An horological movement comprising: a spindle assembly including an escape wheel, a pinion and a common spindle rotationally integral with said escape wheel and said pinion; a driving balance wheel for driving said escape wheel; a driven wheel rotatable about an axis by said pinion; bearing means defining oblong holes for the opposite ends of journalling said spindle, said bearing means being adapted to permit relative movement of the spindle assembly radially of said axis; and biasing means for urging the spindle assembly in the direction towards said axis.

2. A movement as claimed in claim 1, wherein the bearing means comprise means defining oblong openings in which the respective spindle ends are received, said means defining the oblong openings being extended in the direction towards said axis to permit relative movement of the spindle assembly.

3. A movement as claimed in claim 1, which further includes a ratchet wheel that cooperates with the biasing means to prevent rotation of the escape wheel when not driven by the balance wheel.

4. A movement as claimed in claim 1, wherein the spindle assembly further includes a drum member and the biasing means cooperates therewith to prevent rotation of the escape wheel when not driven by the balance wheel.

* * * * *